US006866361B2

(12) United States Patent
Kuki et al.

(10) Patent No.: US 6,866,361 B2
(45) Date of Patent: Mar. 15, 2005

(54) INK-JET RECORDING APPARATUS AND MAINTENANCE METHOD OF INK-JET HEAD INCLUDED IN INK-JET RECORDING APPARATUS

(75) Inventors: Masakazu Kuki, Ichinomiya (JP); Tsugio Okamoto, Kani (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/674,470

(22) Filed: Oct. 1, 2003

(65) Prior Publication Data

US 2004/0125189 A1 Jul. 1, 2004

(30) Foreign Application Priority Data

Oct. 2, 2002 (JP) ..... 2002-289512

(51) Int. Cl.[7] ..... B41J 2/165
(52) U.S. Cl. ..... 347/22; 347/33
(58) Field of Search ..... 347/22, 29, 30, 347/32, 33

(56) References Cited

U.S. PATENT DOCUMENTS

| | | | | |
|---|---|---|---|---|
| 4,951,066 A | | 8/1990 | Terasawa et al. | |
| 5,202,702 A | * | 4/1993 | Terasawa et al. | 347/32 |
| 5,432,539 A | | 7/1995 | Anderson | |
| 5,793,390 A | | 8/1998 | Claflin et al. | |
| 5,815,176 A | * | 9/1998 | Rotering | 347/33 |
| 6,123,409 A | * | 9/2000 | Wolf | 347/33 |
| 6,158,839 A | | 12/2000 | Fukushima et al. | |
| 6,467,873 B1 | * | 10/2002 | Toba et al. | 347/33 |
| 6,619,783 B2 | * | 9/2003 | Kanaya et al. | 347/35 |
| 6,641,248 B2 | * | 11/2003 | Mitsui et al. | 347/29 |
| 6,679,578 B2 | * | 1/2004 | Arakawa | 347/33 |
| 6,692,101 B2 | * | 2/2004 | Lodal et al. | 347/33 |
| 6,742,863 B2 | * | 6/2004 | Takahashi | 347/33 |
| 2002/0044168 A1 | | 4/2002 | Hashi et al. | |

FOREIGN PATENT DOCUMENTS

| | | |
|---|---|---|
| EP | 0 314 513 A2 | 5/1989 |
| JP | B2 2626805 | 4/1997 |
| JP | 11-309871 | 11/1999 |
| JP | 11-342632 | 12/1999 |

* cited by examiner

*Primary Examiner*—Eugene H. Eickholt
(74) *Attorney, Agent, or Firm*—Oliff & Berridge, PLC

(57) ABSTRACT

An ink-jet printer includes a belt conveyor mechanism, an ink-jet head having at its lower face a nozzle face where many nozzles are formed, and a maintenance unit that maintains the ink-jet head. Within the maintenance unit arranged are a blade, a wiping roller, an ink receiving member, and a purge cap, in this order from the near side to the head. The maintenance unit is first moved to a purge position at which the purge cap confronts the nozzle face of the ink-jet head, where a purge operation is performed. After the purge operation, attendant upon movement of the maintenance unit to get apart from the head, the ink receiving member, the wiping roller, and the blade successively confront the nozzle face in this order. With the movement of the maintenance unit, receiving ink with the ink receiving member and wiping ink up with the wiping roller and the blade are performed in order.

17 Claims, 10 Drawing Sheets

INK-JET RECORDING APPARATUS AND MAINTENANCE METHOD OF INK-JET HEAD INCLUDED IN INK-JET RECORDING APPARATUS

BACKGROUND OF THE INVENTION

1. Field of the Invention

The present invention relates to an ink-jet recording apparatus for ejecting ink onto a record medium to print, and also to a maintenance method of an ink-jet head included in the ink-jet recording apparatus.

2. Description of Related Art

In an ink-jet recording apparatus, a nozzle of an ink-jet head may be clogged with ink to deteriorate the ink ejection performance, resulted from generation of bubbles within the nozzle, entrance of dust into the nozzle, an increase in viscosity of ink due to evaporation of an ink solvent, etc. In order to avoid the trouble, in general, an ink-jet recording apparatus includes therein a maintenance unit for removing the above causes of the trouble from nozzles of an ink-jet head. For example, U.S. Pat. No. 4,951,066 discloses a maintenance unit including a purge cap for covering the nozzle face of an ink-jet head where nozzles are arranged, to prevent the nozzles from being dried. The purge cap is connected to a suction pump or the like to forcibly discharge ink. The maintenance unit further includes a blade for cleaning the nozzle face, and a rotatable porous member.

However, if a wiping operation with the blade is performed in a state wherein a relatively large amount of ink has adhered to the nozzle face of the head, ink may fly within the apparatus or may be collected on an edge of the head. In this case, ink may adhere to a print paper or various components within the apparatus. This brings about deterioration of the print quality or a trouble of the mechanical operation.

On the other hand, any porous member has its limit in ink absorption capacity. If the limit is exceeded, the cleaning effect decreases. In a sliding operation of the porous member of the above-described prior art, however, the limit of the ink absorption capacity is easily exceeded because the operation is performed in a state wherein a relatively large amount of ink has adhered to the nozzle face. There is a problem that the cleaning effect is easy to decrease.

SUMMARY OF THE INVENTION

An object of the present invention is to provide an ink-jet recording apparatus in which ink can be prevented from adhering to a print medium and internal parts of the apparatus and ink adhering to a nozzle face can be efficiently removed Upon maintenance of an ink-jet head, and also to provide a maintenance method of an ink-jet head included in the ink-jet recording apparatus.

According to an aspect of the present invention, an ink-jet recording apparatus comprises a medium conveyance mechanism that conveys a record medium; an ink-jet head that has a nozzle face where a plurality of nozzles are arranged, for ejecting ink through the nozzles onto the record medium conveyed by the medium conveyance mechanism; and a maintenance unit. The maintenance unit comprises an ink receiving member in which a plurality of protrusions are arranged. The protrusions can be brought into contact with ink adhering to the nozzle face, for receiving the ink in a space between the protrusions. The maintenance unit further comprises a first wiping member that is able to be brought into contact with the nozzle face to wipe up ink adhering to the nozzle face; and a driving mechanism that moves the maintenance unit so that the ink receiving member receives ink adhering to the nozzle face and then the first wiping member wipes up ink adhering to the nozzle face.

According to another aspect of the present invention, a maintenance method of an ink-jet head comprises an ink receiving step for bringing ink adhering to a nozzle face on the ink-jet head where a plurality of nozzles are arranged into contact with protrusions arranged on an ink receiving member so as to receive the ink in a space between the protrusions; and a first wiping step for bringing a first wiping member into contact with the nozzle face so as to wipe up ink adhering to the nozzle face with the first wiping member, after the ink receiving step.

According to the invention, upon maintenance of the ink-jet head, before the first wiping member wipes up ink adhering to the nozzle face, the ink receiving member receives and removes some part of the ink in advance Thereby, ink can be efficiently removed. In addition, troubles can be avoided in which ink flies within the apparatus and ink is collected on an end portion of the ink-jet head, which troubles may arise in case that a wiping operation with a blade is performed in a state wherein ink has adhered to the nozzle face of the ink-jet head. Therefore, ink can be prevented from adhering to a print medium or internal parts of the apparatus.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

First, a general construction of an ink-jet printer as an ink-jet recording apparatus according to an embodiment of the present invention will be described with reference to FIG. 1. The ink-jet printer 1 of this embodiment is a color ink-jet printer having four ink-jet heads 2. The ink-jet printer 1 includes therein a paper feed unit 11 and a paper discharge unit 12 in left and right portions of FIG. 1, respectively. A paper conveyance path is formed extending from the paper feed unit 11 to the paper discharge unit 12 within the ink-jet printer 1.

Figure 1:
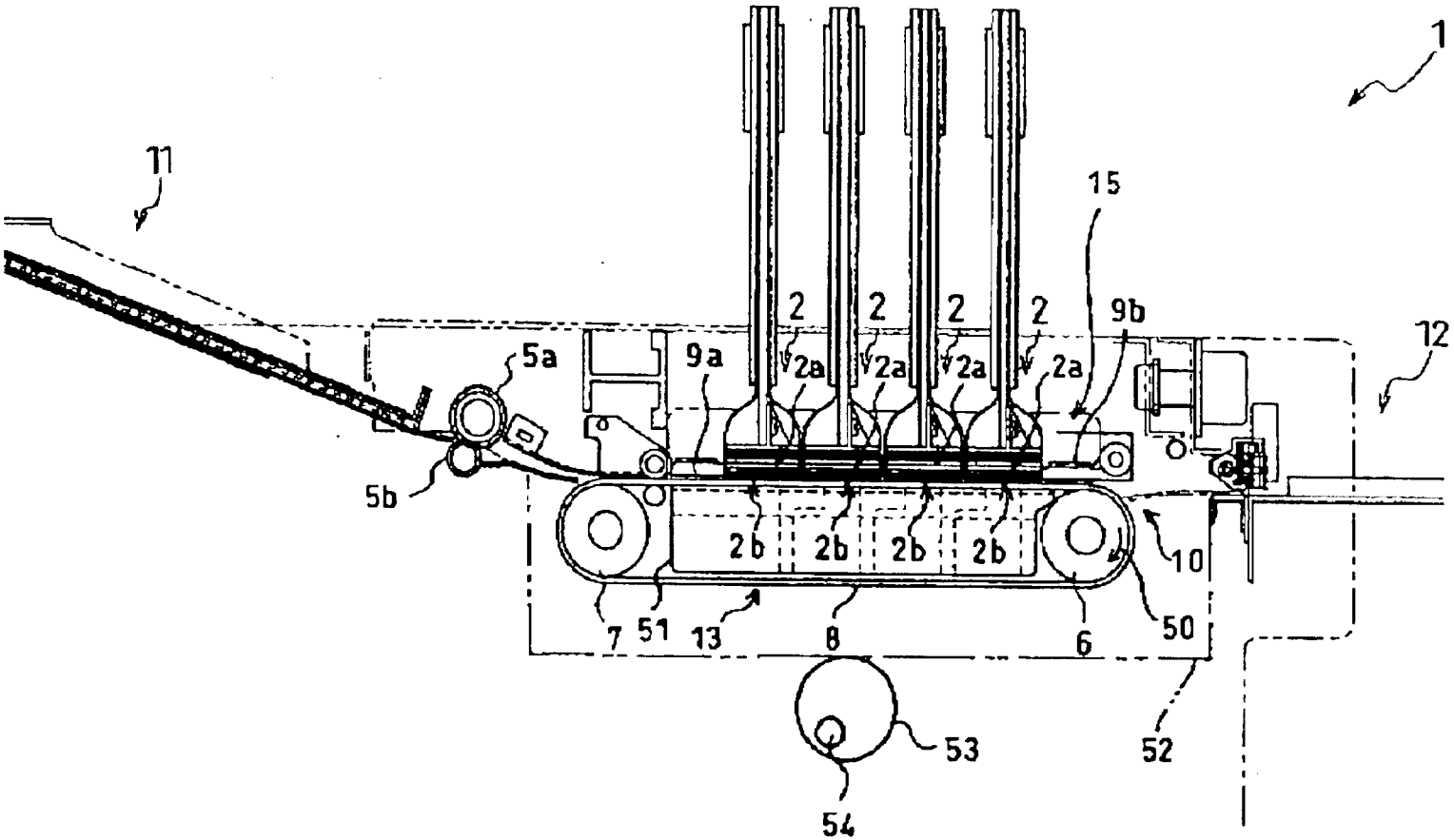
FIG. 1 is a front view of an ink-jet printer according to an embodiment of the present invention.

A pair of paper feed rollers 5*a* and 5*b* are disposed immediately downstream of the paper feed unit 11 for putting forward a paper as a record medium from the left to the right in FIG. 1. In the middle of the paper conveyance path, a belt conveyor mechanism 13 as a medium conveyance mechanism is provided. The belt conveyor mechanism 13 includes two belt rollers 6 and 7 and a looped conveyor belt 8. The conveyor belt 8 is wrapped around the belt rollers 6 and 7 to be stretched between them.

The conveyor belt 8 has a two-layered structure made up of a polyester base body impregnated with urethane and a silicone rubber. The silicone rubber is disposed in the outer portion of the conveyor belt 8 to form a conveyor face. A paper fed through the pair of paper feed rollers 5*a* and 5*b* is kept on the conveyor face of the conveyor belt 8 by adhesion, In this state, the paper is conveyed downstream, i.e., rightward in FIG. 1, by driving one belt roller 6 to rotate clockwise in FIG. 1 as indicated by an arrow 50.

Pressing members 9*a* and 9*b* are provided at positions for feeding a paper onto the conveyor belt 8 and discharging the paper from the conveyor belt 8, respectively. Either of the pressing members 9*a* and 9*b* is for pressing the paper onto the conveyor face of the conveyor belt 8 so as to prevent the paper from separating from the conveyor face. Thus, the paper is surely kept on the conveyor face.

A peeling device 10 is provided in the paper conveyance path immediately downstream of the conveyor belt 8, i.e., on the right in FIG. 1. The peeling device 10 peels off the paper, which is kept on the conveyor face of the conveyor belt 8 by adhesion, from the conveyor face so that the paper can be transferred toward the rightward paper discharge unit 12.

Each of the four ink-jet heads 2 has, at its lower end, a head main body 2*a*. Each head main body 2*a* has a rectangular section. The head main bodies 2*a* are arranged close to each other with the longitudinal direction of each head main body 2*a* being perpendicular to the paper conveyance direction, i.e., perpendicular to FIG. 1. That is, this printer 1 is a line type printer. The bottom of each of the four head main bodies 2*a* faces the paper conveyance path. In the bottom of each head main body 2*a*, a large number of small-diameter nozzles are arranged though the nozzles are not illustrated in FIG. 1. Hereinafter, the bottom face of each ink-jet head 2 will be referred to as a nozzle face 2*b*. The four head main bodies 2*a* eject ink of magenta, yellow, cyan, and black, respectively.

The head main bodies 2*a* are disposed such that a narrow clearance is formed between each nozzle face 2*b* and the conveyor face of the conveyor belt 8. The paper conveyance path is formed within the clearance. In this construction, while a paper, which is being conveyed by the conveyor belt 8, passes immediately below the four head main bodies 2*a* in order, the respective color inks are ejected through the corresponding nozzles toward the upper face, i.e., the print face, of the paper to form a desired color image on the paper.

The belt rollers 6 and 7 and the conveyor belt 8 are supported by a lifting mechanism including a chassis 52. When a maintenance unit 20 as will be described later is transversely moved, the belt rollers 6 and 7 and the conveyor belt 8 are moved up or down by the lifting mechanism.

Figure 3:
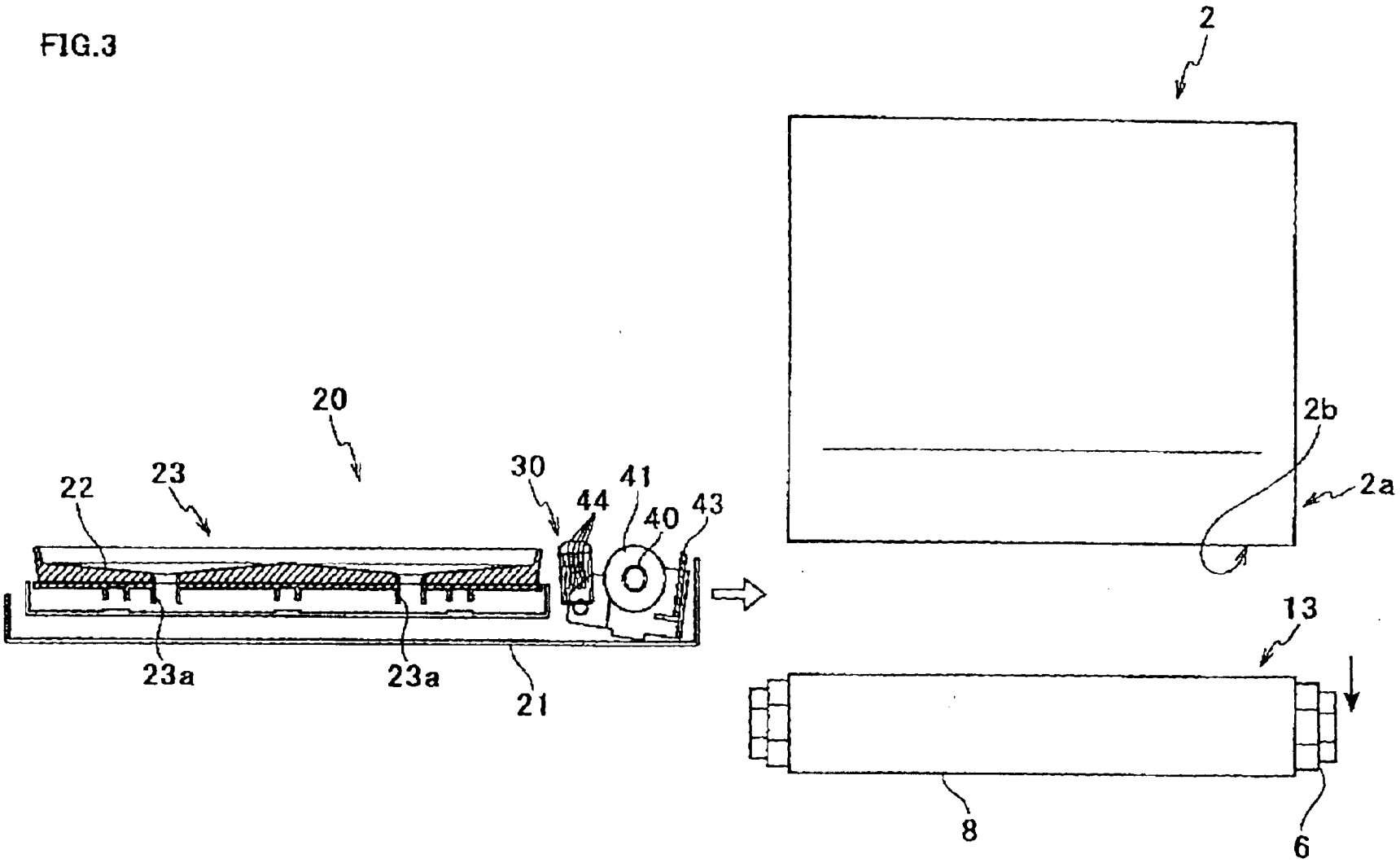
FIG. 3 is a view illustrating a state wherein the maintenance unit of FIG. 2 starts to move from a withdrawal position toward a purge position after the belt conveyor mechanism moves from a conveyance position to a non-conveyance position.

The chassis 52 of the lifting mechanism is put on a cylindrical member 53 disposed under the chassis 52. The cylindrical member 53 is rotatable around a shaft 54 provided at a position deviating from the center of the cylindrical member 53. Thus, by rotating the shaft 54, the level of the uppermost portion of the cylindrical member 53 can be changed to move up or down the chassis 52 accordingly. When the maintenance unit 20 is transversely moved as will be described later, the cylindrical member 53 must have been rotated at an adequate angle in advance so as to move down the chassis 52, the conveyor belt 8, and the belt rollers 6 and 7 by a pertinent distance from the position illustrated in FIG. 1. A space for the movement of the maintenance unit 20 is thereby ensured as illustrated in FIG. 3.

In the region surrounded by the conveyor belt 8, a nearly rectangular parallelepiped guide 51 having its width substantially equal to that of the conveyor belt. 8 is disposed at an opposite position to the ink-jet heads 2. The guide 51 is in contact with the lower face of the upper part of the conveyor belt 8 to support the upper part of the conveyor belt 8 from the inside.

Figure 2:
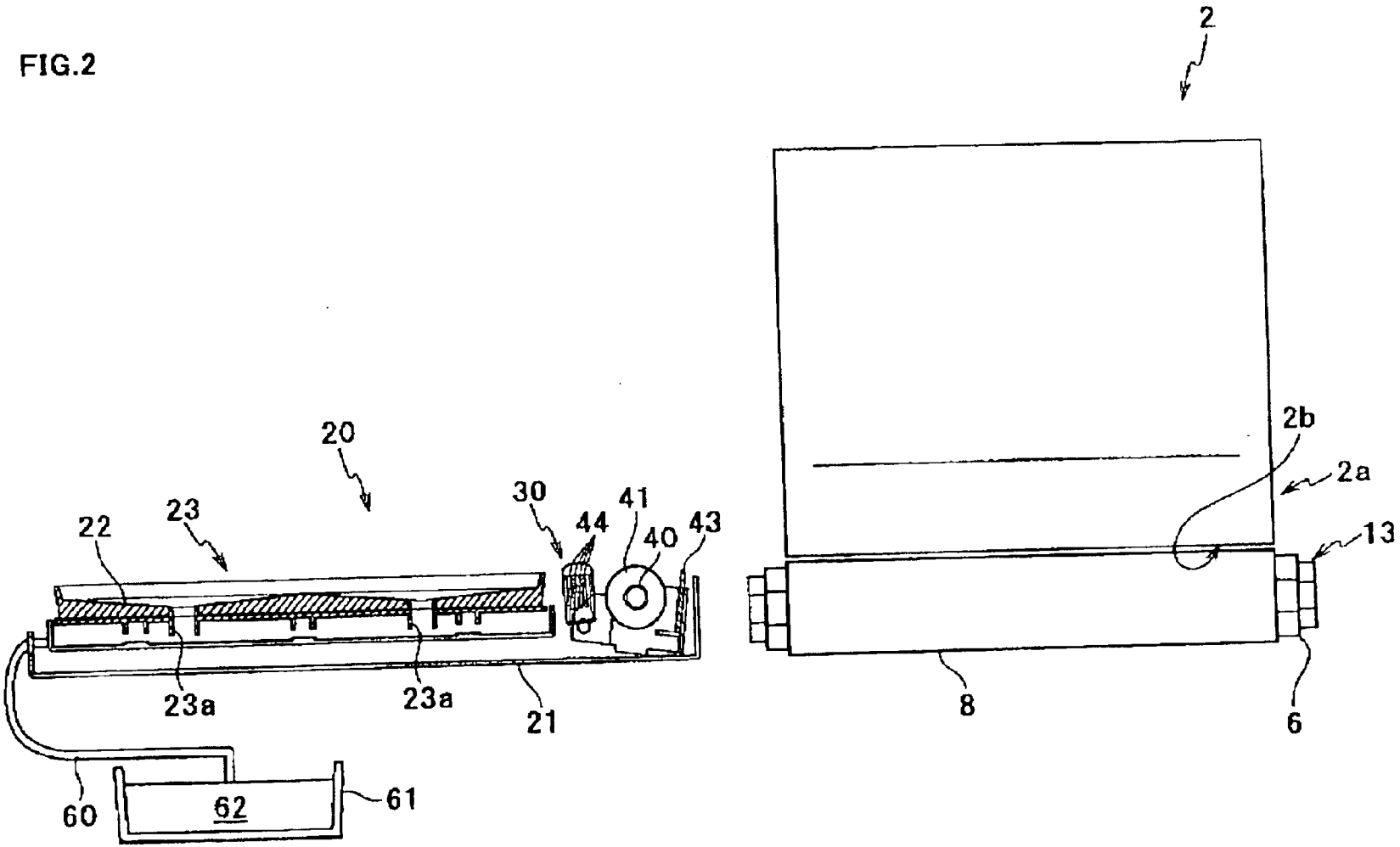
FIG. 2 is a view of an ink-jet head, a belt conveyor mechanism, and a maintenance unit, viewed from the left of FIG. 1.

Next, the construction of a maintenance unit 20 provided in the ink-jet printer 1 for maintaining the ink-jet heads 2 will be described with reference to FIG. 2. FIG. 2 is a view of an ink-jet head, the belt conveyor mechanism, and the maintenance unit, viewed from the left of FIG. 1. The maintenance unit 20 is disposed behind the belt conveyor mechanism 13 in FIG. 1.

The maintenance unit 20 includes a frame 21 movable transversely as will be described later. Within the frame 21, a blade 43 as a second wiping member, a wiping roller 41 as a first wiping member, an ink receiving member 30, and purge caps 22 are disposed in this order from the side near the ink-jet heads 2.

Figure 9:
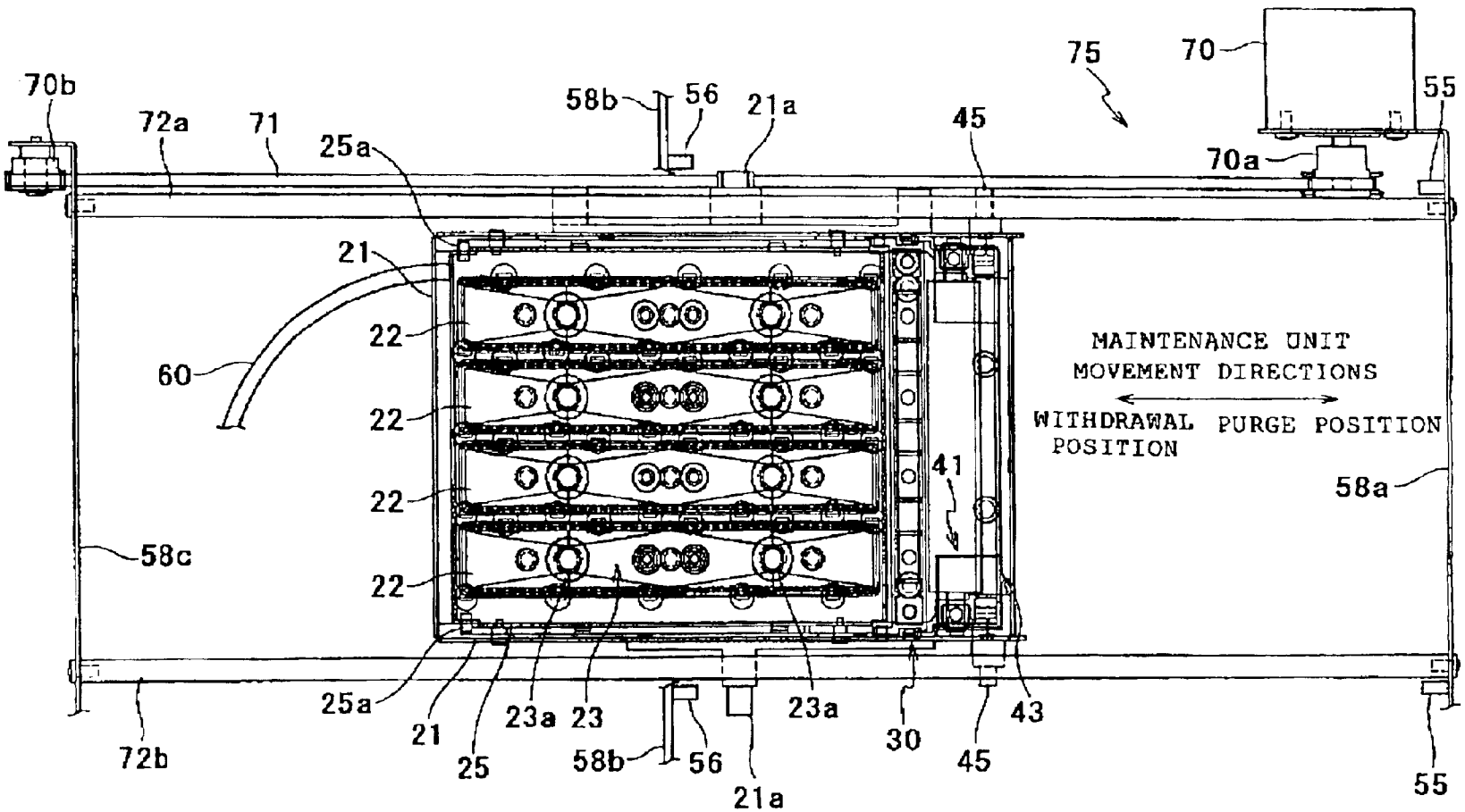
FIG. 9 is an upper view of the maintenance unit and a driving mechanism included in the maintenance unit.

FIG. 2 illustrates only one purge cap 22. In the ink-jet printer 1, however, four purge caps 22 are arranged perpendicularly to FIG. 2 as illustrated in FIG. 9 so that the four purge caps 22 can cover the respective nozzle faces 2*b* of the four ink-jet heads 2. Each purge cap 22 is made of an elastic material such as rubber. The purge cap 22 can be in close contact with the nozzle face 2*b* of the corresponding ink-jet head 2 so as to hermetically cover the nozzle face 2*b*. Each purge cap 22 is connected to a non-illustrated purge pump. The purge cap 22 and the purge pump constitute a purge mechanism 23. A purge operation as will be described later in detail is performed with the purge mechanism 23. The purge pump may be mounted within the frame 21, or may be provided at an adequate position outside the frame 21 within the apparatus.

Each purge cap 22 has two ink discharge ports 23*a*. Ink with dust or the like having sucked by a purge operation as will be described later in detail flows out through the ink discharge ports 23*a* and then it is absorbed in a non-illustrated absorber disposed under the purge cap 22. The ink is further introduced through a tube 60 into a waste ink reservoir 61 and absorbed and kept in an absorber 62 in the waste ink reservoir 61.

The ink receiving member 30 includes therein a plurality of thin plates 44 as protrusions each having a length somewhat larger than the total width of the arranged four ink-jet heads 2. The thin plates 44 are arranged parallel to each other so that each thin plate 44 is along an arrangement direction of the ink-jet heads 2, i.e., perpendicularly to FIG. 2, to include therein the total width of the ink-jet heads 2. The thin plates 44 confront each other in a longitudinal direction of each ink-jet head 2, i.e., transversely in FIG. 2.

The wiping roller 41 is cylindrical. The wiping roller 41 is rotatably supported on a shaft 40 parallel to each nozzle face 2*b*, more specifically, along an arrangement direction of the ink-jet heads 2, i.e., perpendicular to FIG. 2. The wiping roller 41 has an axial length somewhat larger than the total width of the arranged four ink-jet heads 2, like the above-described thin plates 44. The wiping roller 41 is made of a porous material such as urethane capable of absorbing ink.

The blade 43 has a length somewhat larger than the total width of the arranged four ink-jet heads 2, like the above-described thin plates 44 and wiping roller 41. The blade 43 is disposed along an arrangement direction of the ink-jet heads 2, i.e., perpendicularly to FIG. 2. The blade 43 is made of a flexible material such as rubber.

While the ink-jet printer 1 is not in a maintenance operation as will be described later, the maintenance unit 20 stays at a withdrawal position, i.e., a non-purge position, spaced apart from each ink-jet head 2, as illustrated in FIG. 2. At this time, the upper end of each of the components 22, 41, and 43 in the frame 21 except the ink receiving member 30 is at a level somewhat lower than the nozzle face 2*b* of the corresponding ink-jet head 2 so that it can not come into contact with the nozzle face 2*b* when the four purge caps 22 are transversely moved from the withdrawal position to a purge position where each purge cap 22 confronts the nozzle face 2*b* of the corresponding ink-jet head 2. The ink receiving member 30 is, on the other hand, biased upward with a small force by a compression spring, etc., and at the same time, this biasing force brings guide portions formed at both ends of each thin plate 44 into contact with both sides of the nozzle face 2*b* in the head holder 15 (see FIG. 1). With this construction, a narrow clearance (e.g., 0.5 mm) may always be formed between the upper end of the thin plate 44 and the nozzle face 2*b* of the head 2.

The frame 21 is movable only transversely in FIG. 2 and its vertical level is fixed. However, any of the components 22, 41, and 43 in the frame 21 except the ink receiving member 30 is vertically movable relatively to the frame 21. Thus, upon a maintenance operation as will be described later, the distance between each of the components 22, 41, and 43 in the frame 21 and the nozzle face 2*b* of the corresponding ink-jet head 2 can be adequately changed. The ink receiving member 30 is, on the other hand, immovable relatively to the frame 21 and still kept in a state in the above-mentioned withdrawal position (a state where the narrow clearance (e.g., 0.5 mm) is formed between the upper end of the thin plate 44 and the nozzle face 2*b*), during the horizontal movement of the frame 21.

Next, a driving mechanism 75 for transversely moving the maintenance unit 20 will be described with reference to FIG. 9. FIG. 9 is an upper view of the maintenance unit and the driving mechanism included in the maintenance unit.

The driving mechanism 75 included in the maintenance unit 20 has an electric motor 70, a motor pulley 70*a*, an idle pulley 70*b*, a timing belt 71, and guide shafts 72*a* and 72*b*. The motor 70 is attached to a main frame 58*a* in the right of FIG. 9 with screws or the like. The motor pulley 70*a* is connected to the motor 70 to rotate with the drive of the motor 70. The idle pulley 70*b* is rotatably supported by a main frame 58*c* in the left of FIG. 9. The timing belt 71 is wrapped around the motor pulley 70*a* and the idle pulley 70*b* in a pair to be stretched between them. The timing belt 71 is connected to a bearing 21*a* protruding beyond both sides in the width of the frame 21. Each of the guide shafts 72*a* and 72*b* is fixed to the left and right main frames 58*a* and 58*c* with screws or the like to extend between the frames 58*a* and 58*c* parallel to the timing belt 71. The guide shafts 72*a* and 72*b* support both sides in the width of the maintenance unit 20 through the bearing 21*a* and so on.

In this construction, when the motor 70 is driven, the motor pulley 70*a* is rotated clockwise or counterclockwise to run the timing belt 71. With the run of the timing belt 71, the maintenance unit 20 connected to the timing belt 71 through the bearing 21*a* is moved in the left or right direction in FIG. 9, i.e., toward the purge or withdrawal position.

Figure 10A:
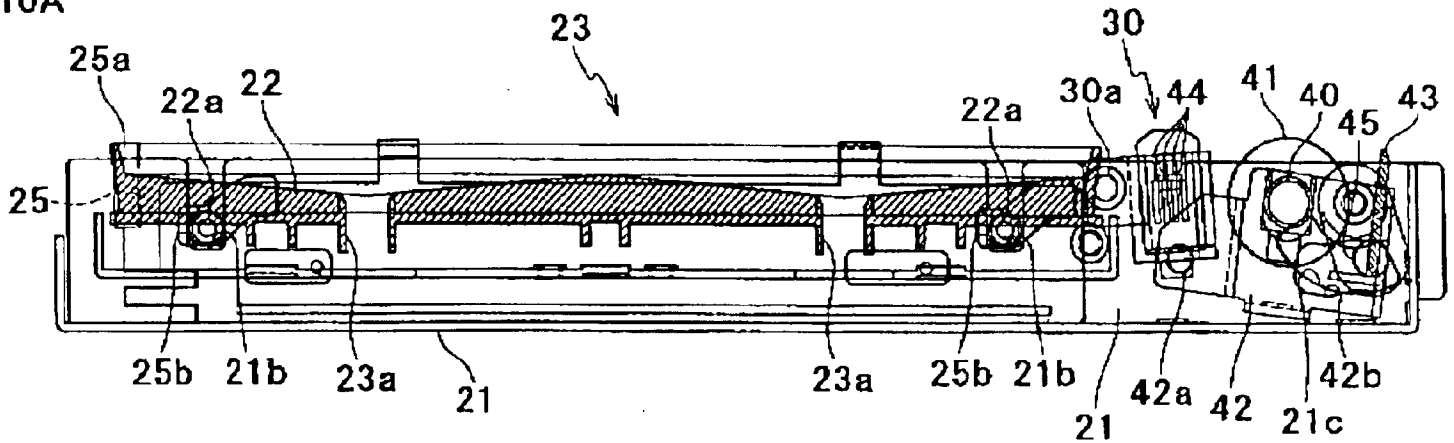
FIG. 10A is a view illustrating operations of parts of the maintenance unit within a frame, in a state wherein the maintenance unit is at the withdrawal position.
Figure 10B:
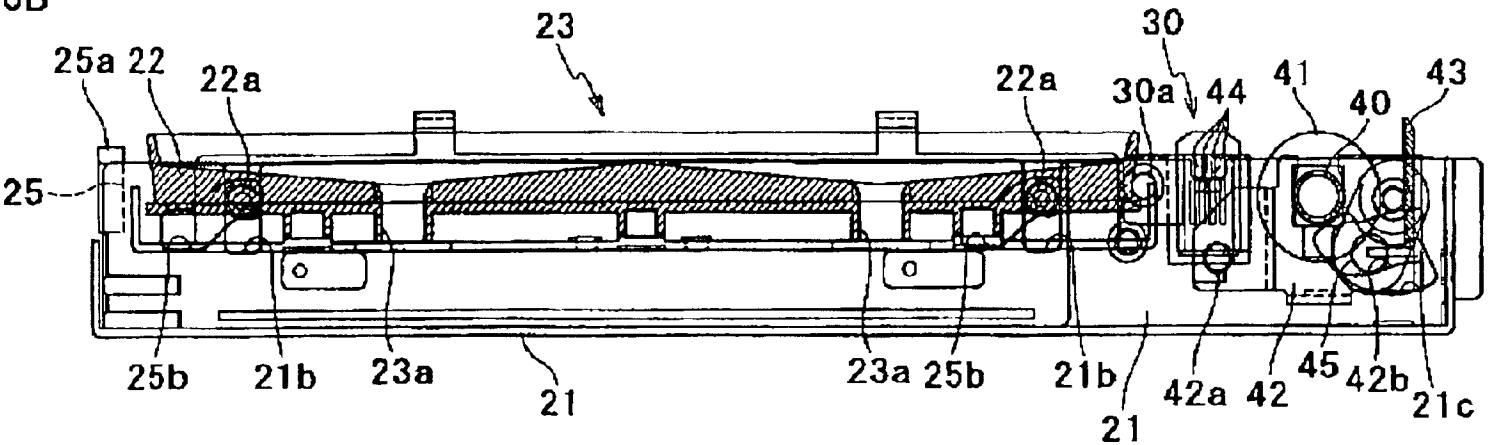
FIG. 10B is a view illustrating operations of the parts of the maintenance unit within the frame, in a state wherein the maintenance unit is at the purge position.

Next, a more detailed configuration of each member 22, 30, 41, and 43 included in the maintenance unit 20 and a vertical movement of each member 22, 41, and 43 in the frame 21 except the ink receiving member 30 will be described with reference to FIGS. 10A and 10B. The below-described vertical movement of each member 22, 41, and 43 in the frame 21 except the ink receiving member 30 is also realized by the driving mechanism 75 illustrated in FIG. 9.

The frame 21 receiving therein the maintenance unit 20 includes a cap plate 25 disposed inside the frame 21 to correspond to the purge caps 22.

The four purge caps 22 are supported in the manner that shafts 22*a* are inserted in cam holes 25*b* formed in the cap plate 25. The shafts 22*a* are inserted also in grooves 21*b* formed in the frame 21.

The ink receiving member 30 is supported by the frame 21 through a shaft 30*a*. A plate 42 supporting the wiping roller 41 and the blade 43 is attached to the frame 21 through a shaft 42*a*. Cam holes 42*b* are formed in the plate 42. An operating shaft 45 moving vertically the wiping roller 41 and the blade 43 is inserted in the cam holes 42*b* and fan-shaped holes 21*c* formed in the frame 21.

When the maintenance unit 20 is moved rightward in FIG. 10A, i.e., toward the ink-jet heads 2 in FIG. 2, a protrusion. 25*a* provided on the cap plate 25 is brought into contact with a non-illustrated projection provided below a head holder 15 (see FIG. 1) immediately before the maintenance unit 20 reaches the purge position (see FIG. 4). The components of the maintenance unit 20 other than the cap plate 25 are further moved rightward in FIG. 10A in a state wherein the movement of the cap plate 25 is stopped by the projection. As the frame 21 is moved, the shaft 22*a* inserted in the grooves 21*b* formed in the frame 21 is moved in an upper direction along the cam holes 25*b*, as illustrated in FIG. 10B. The purge caps 22 are elevated with the movement of the shaft 22*a* so that the upper ends of the purge caps 22 is in close contact with the nozzle faces 2*b* of the ink-jet heads 2 when the maintenance unit 20 is at the purge position. The purge caps 22 are biased upward by a non-illustrated spring, and therefore pushed against the nozzle faces 2*b* by the pressure from the springs. When the maintenance unit 20 reaches the purge position, the shaft 22*a* is stopped by the upper right ends of the cam holes 25*b* to stop the movement of the whole of the maintenance unit 20 including the frame 21.

On the other hand, substantially at the same time when the protrusion 25*a* provided on the cap plate 25 is brought into contact with the projection provided below the head holder 15, the operating shaft 45 moving vertically the wiping roller 41 and the blade 43 is brought into contact with metallic parts 55 provided on the left main frame 58*a* of FIG. 9. The frame 21, etc., is further moved rightward in FIG. 10A in a state wherein the metallic parts 55 stop the movement of the operating shaft 45. Thereby, the operating shaft 45 inserted in both of the cam holes 42*b* and the fan-shaped holes 21*c* is moved leftward in FIG. 10A relatively to the frame 21, as illustrated in FIG. 10B. With the movement of the operating shaft 45, the plate 42 supporting the wiping roller 41 and the blade 43 is rotated counterclockwise around the shaft 42*a*. At this time, the ink receiving member 30 does not move. Accordingly, when the maintenance unit 20 is at the purge position, the thin plates 44 provided in the ink receiving member 30 are set at positions with the narrow clearance (e.g., 0.5 mm) being formed between the upper ends thereof and the nozzle faces 2*b*. The upper end of the wiping roller 41 is set substantially at the same level as that of the nozzle faces 2*b*. The tip end of the blade 43 is set at a level somewhat higher than that of the nozzle faces 2*b* so that the blade 43 is bent when it is brought into contact with the nozzle faces 2*b*.

After a purge operation as will be described later is performed at the purge position, the maintenance unit 20 starts to move leftward in FIG. 10B toward the withdrawal position, i.e., in the direction to get apart from the ink-jet heads 2 in FIG. 2. Immediately after this, the engagement between the protrusion 25*a* of the cap plate 25 and the non-illustrated projection provided below the head holder 15 is relieved. The cap plate 25 including the cam holes 25*b* is biased leftward in FIG. 10B by a non-illustrated spring. Therefore, the cap plate 25 moves leftward and the shaft 22*a* moves along the cam holes 25*b*. Thereby, the purge cap 22 is moved down to return to the same state as that when the maintenance unit 20 is at the withdrawal position as illustrated in FIG. 10A.

Contrastingly, even after the engagement between the protrusion 25*a* and the projection provided below the head holder 15 is relieved, the wiping roller 41 and the blade 43 are kept in the state of FIG. 10B. This is because the operating shaft 45 supporting the wiping roller 41 and the blade 43 is biased upward by a non-illustrated spring in a state wherein the operating shaft 45 is pushed leftward in the cam holes 42*b* formed in the plate 42. Afterward, the maintenance unit 20 is further moved toward the withdrawal position. Immediately before the maintenance unit 20 reaches the withdrawal position, the operating shaft 45 is brought into contact with metallic parts 56 provided on the central main frame 58*b* of FIG. 9. The frame 21, etc., is further moved leftward in FIG. 10B in a state wherein the metallic parts stop the movement of the operating shaft 45. Thereby, the operating shaft 45 inserted in the cam holes 42*b* and the fan-shaped holes 21*c* is moved rightward in FIG. 10B. The state of FIG. 10A where the wiping roller 41 and the blade 43 have been moved down is obtained at the same time when the maintenance unit 20 reaches the withdrawal position.

Next, a maintenance method of the ink-jet heads 2 with the maintenance unit 20 will be described. Maintenance with the maintenance unit 20 is performed, for example, when ink is introduced into the ink-jet heads 2 from a ink supply source, i.e., a non-illustrated ink cartridge, upon the first use of the printer 1, when the printer 1 is used after it is not used for a predetermined time, or when printing on a predetermined number of papers is completed.

In FIGS. 3 to 8 that will be referred to hereinafter, the tube 60, the waste ink reservoir 61, and the absorber 62 of FIG. 2 are omitted.

When maintenance of the ink-jet heads 2 with the maintenance unit is performed, the belt conveyor mechanism 13 has been beforehand moved, by the above-described lifting mechanism, to a lower non-conveyance position that is spaced apart from the nozzle faces 2*b*. In this state, the maintenance unit 20 is transversely moved by the above-described driving mechanism of FIG. 9 from the withdrawal position to the right in FIG. 3 toward the ink-jet heads 2 so as to enter the space between the ink-jet heads 2 and the belt conveyor mechanism 13.

The maintenance unit 20 is then disposed at the purge position (a cap disposition step). In this step, as described above, each purge cap 22 is elevated so that its upper end is in close contact with the corresponding nozzle face 2*b*, and simultaneously with this, each of the wiping roller 41 and the blade 43 is moved relatively to the frame 21 so that its upper end is at a predetermined level relative to the nozzle faces 2*b* (see FIG. 4).

The maintenance unit 20 is once stopped at the purge position, where a purge operation with the purge caps 22 is performed (a purge step). To perform the purge operation, in a state wherein each purge cap 22 covers the nozzle face 2*b* of the corresponding ink-jet head 2 as illustrated in FIG. 4, the above-described non-illustrated purge pump is driven to apply suction force to each nozzle. As a result, ink containing dust or bubbles or ink having increased in viscosity is sucked out of the nozzle, and ink passages provided within each ink-jet head 2 are filled up with ink from an ink cartridge. The sucked-out ink is discharged into the waste ink reservoir 61 of FIG. 2, as described above.

Figure 4:
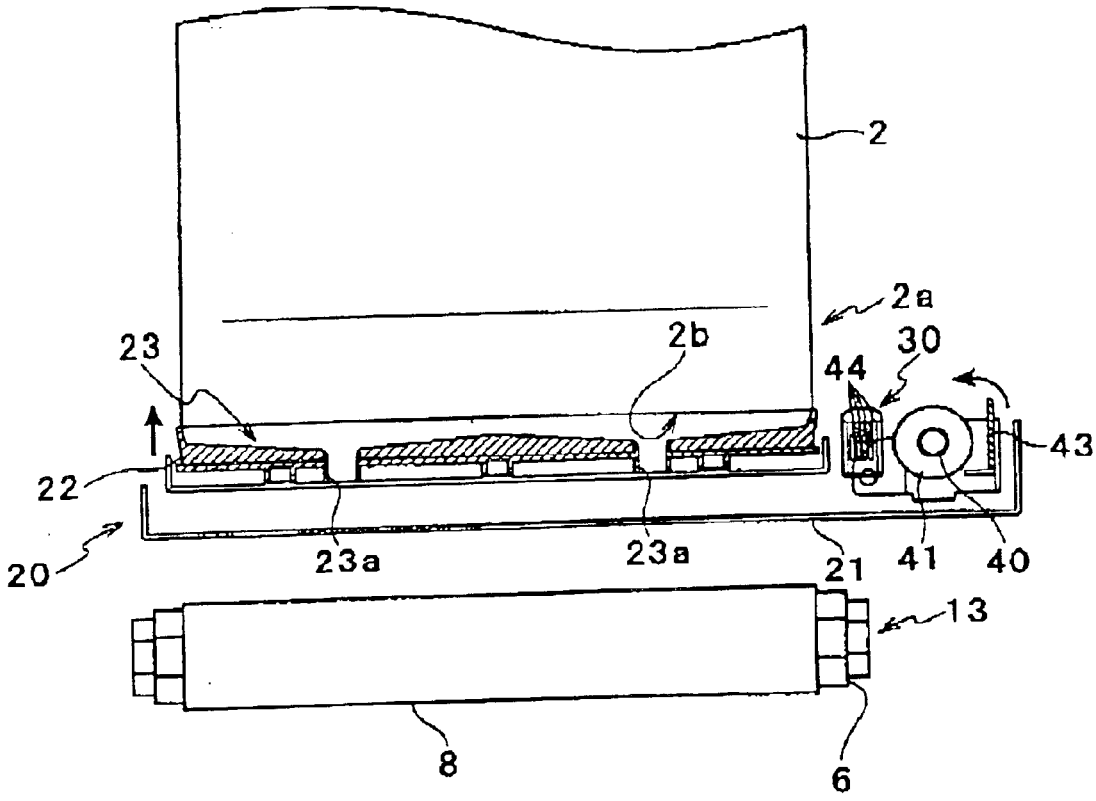
FIG. 4 is an enlarged view illustrating a state wherein a purge step is performed.
Figure 5:
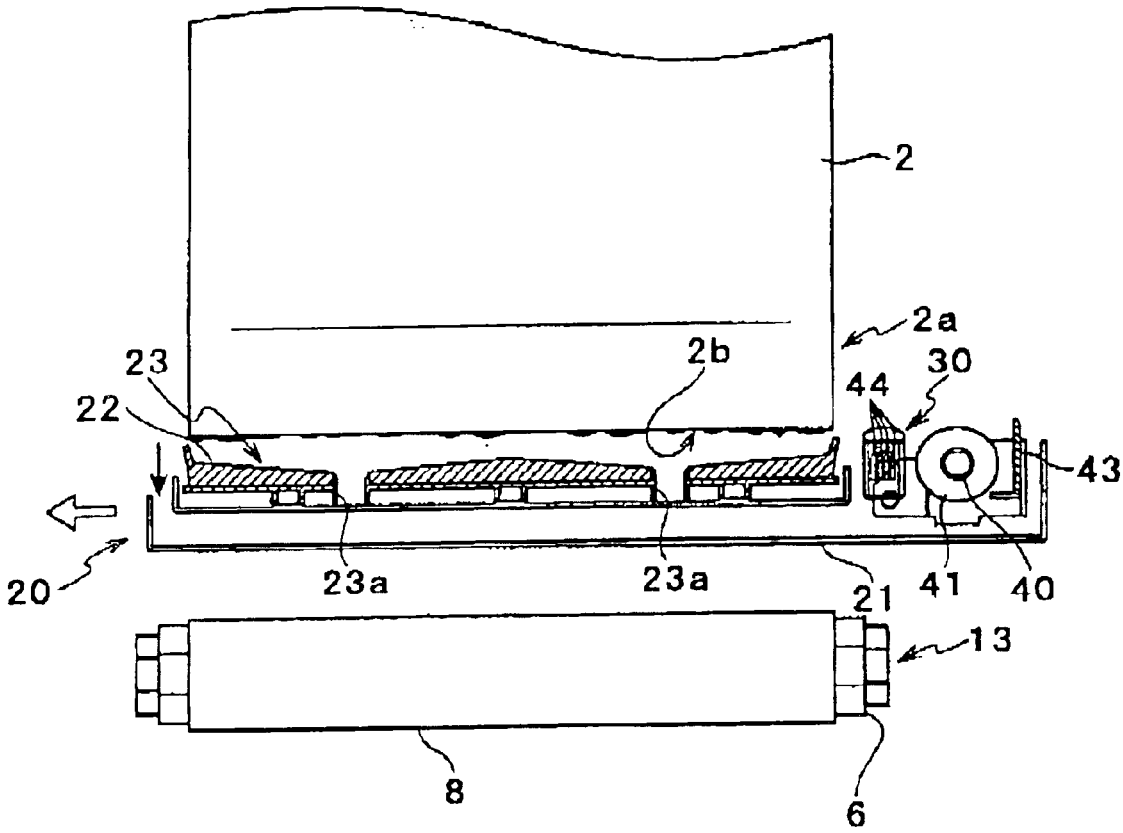
FIG. 5 is a view illustrating a state wherein a large amount of ink has adhered to the lower face of the ink-jet head after the purge step is completed.

When the maintenance unit 20 starts to move to the left in FIG. 4 toward the withdrawal position after the purge step is completed, each purge cap 22 is moved down so that its upper end is at a level somewhat lower than that of the nozzle face 2*b* of the corresponding ink-jet head 2, as illustrated in FIG. 5. As a result, the nozzle face 2*b* of each ink-jet head 2 that was covered with the corresponding purge cap 22 is exposed. As illustrated in FIG. 5, droplets of ink sucked out of nozzles may adhere to the nozzle faces 2*b* of the ink-jet heads 2.

At this time, any of the ink receiving member 30, the wiping roller 41, and the blade 43 is kept in the state of FIG. 4, as described above.

Afterward, the maintenance unit 20 is further moved toward the withdrawal position. In this movement, the ink receiving member 30, the wiping roller 41, and the blade 43 confront the nozzle faces 2*b* of the ink-jet heads 2 in order. An ink receiving step, a first wiping step, and a second wiping step are performed with the respective components.

Figure 6:
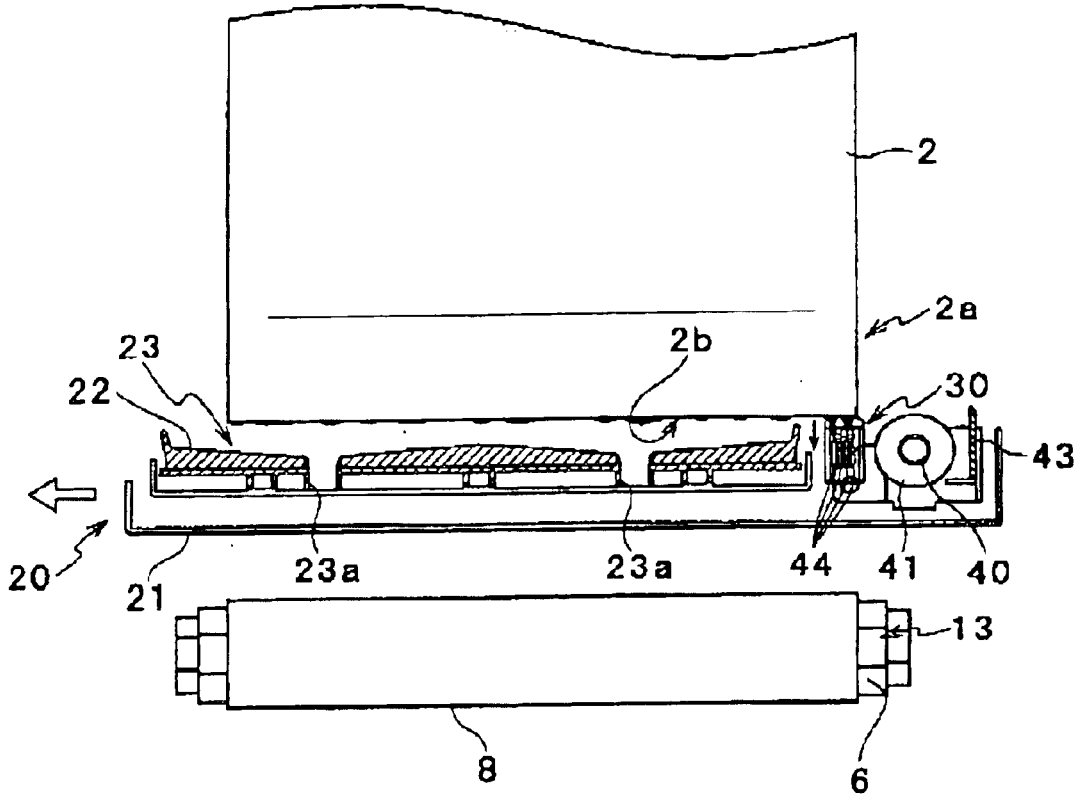
FIG. 6 is a view illustrating a state wherein an ink receiving step with an ink receiving member is performed.

FIG. 6 is a view illustrating a state wherein an receiving step with the ink receiving member 30 is performed. In this step, the upper end of each thin plate 44 in the ink receiving member 30 is not in contact with the nozzle faces 2*b* of the ink-jet heads 2 but at a predetermined small distance (e.g., 0.5 mm) from the nozzle faces 2*b*. In this state wherein the thin plates 44 arranged adjacently in parallel with each other within the ink receiving member 30 are not in contact with the nozzle faces 2*b* of the ink-jet heads 2, relatively large droplets of ink adhering to the nozzle faces 2*b* are brought into contact with the thin plates 44. Thereby, those large droplets are transferred into spaces between the thin plates 44 (an ink receiving step).

Figure 7:
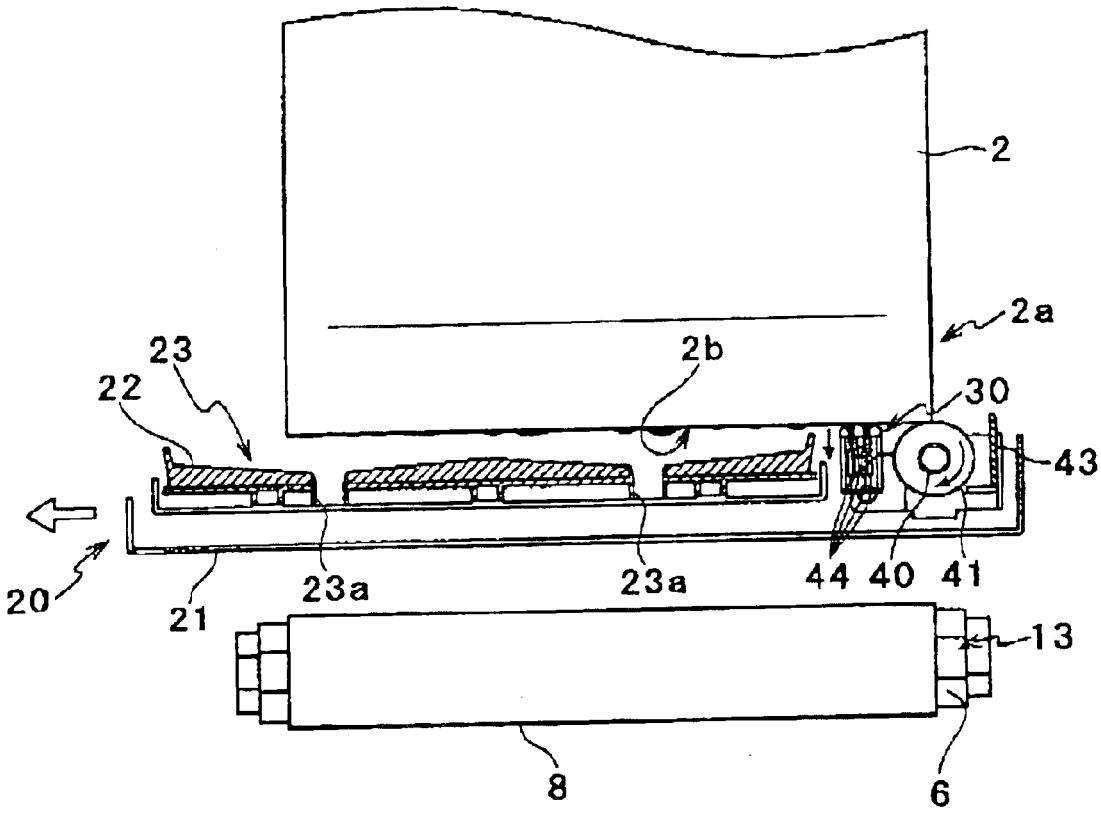
FIG. 7 is a view illustrating a state wherein a first wiping step with a wiping roller is performed while the maintenance unit further moves from the state of FIG. 6 toward the withdrawal position.

FIG. 7 is a view illustrating a state wherein a first wiping step with the wiping roller 41 is performed while the maintenance unit 20 is further moved from the state of FIG. 6 toward the withdrawal position. As described above, the wiping roller 41 is pushed against the nozzle faces 2*b* with a small force. Therefore, when the wiping roller 41 confronts the nozzle faces 2*b*, the wiping roller 41 is brought into contact with the nozzle faces 2*b*. Further, the wiping roller 41 is rotatably supported on the shaft 41. Therefore, the wiping roller 42 in contact with the nozzle faces 2*b* is rotated counterclockwise as shown with an arrow in FIG. 7, attendant upon the movement of the maintenance unit 20. Thus, small droplets of ink adhering to the nozzle faces 2*b*, which have not been removed by the ink receiving member 30, are wiped off (a first wiping step). Because the wiping roller 41 is made of a porous material capable of absorbing ink, as described above, the wiped-off ink is absorbed from the surface to the inside of the wiping roller 41.

Figure 8:
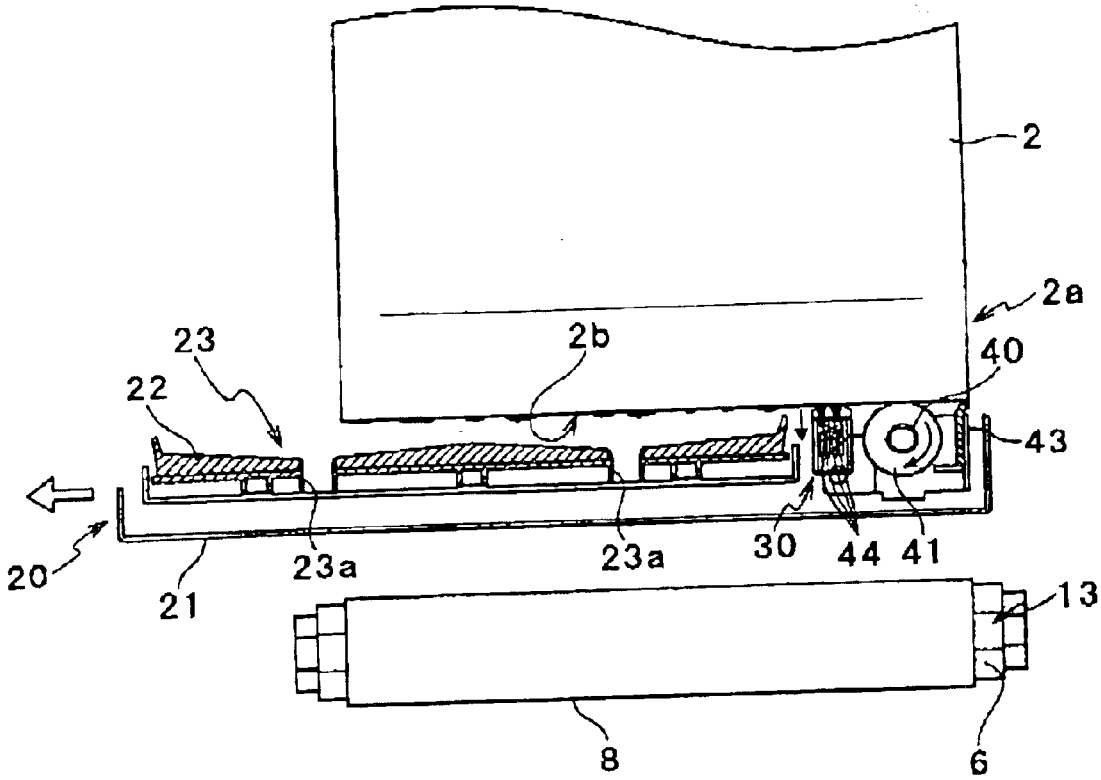
FIG. 8 is a view illustrating a state wherein a second wiping step with a blade is performed while the maintenance unit further moves from the state of FIG. 7 toward the withdrawal position.

FIG. 8 is a view illustrating a state wherein a second wiping step with the blade 43 is performed while the maintenance unit 20 is further moved from the state of FIG. 7 toward the withdrawal position. As described above, the upper end of the blade 43 is at a level somewhat higher than that of the nozzle faces 2*b*. Therefore, when the blade 43 confronts the nozzle faces 2*b*, the blade 43 is brought into contact with the nozzle faces 2*b* with being bent. Thus, the blade 43 scrapes off ink adhering to the nozzle faces 2*b*. Thereby, smaller droplets of ink adhering to the nozzle faces 2*b*, which have not been removed even by the wiping roller 41, are wiped off (a second wiping step).

As described above, in the ink-jet printer 1 of this embodiment, upon maintenance of the ink-jet heads 2, before the wiping roller 41 wipes up ink adhering to the nozzle faces 2*b*, the ink receiving member 30 receives and removes some part of the ink in advance. Thereby, ink can be efficiently removed. In addition, troubles can be avoided in which ink flies within the apparatus and ink is collected on an end portion of each ink-jet head 2, which troubles may arise in case that a wiping operation with the blade 43 is performed in a state wherein ink has adhered to the nozzle faces 2*b* of the ink-jet heads 2. Therefore, ink can be prevented from adhering to a print paper or internal parts of the apparatus.

Since the maintenance unit of this embodiment includes the purge caps for sucking ink out of the nozzles, an ink receiving operation with the ink receiving member 30 is performed after a purge operation. Large droplets of ink are apt to adhere to the nozzle faces in particular after the purge operation. In this case, by receiving and removing some of ink with the ink receiving member 30 in advance before wiping with the wiping roller 41 or blade 43, the above-described effect that ink is prevented from adhering to a print paper or internal parts of the apparatus, can be obtained more effectively.

The driving mechanism 75 of FIG. 9 dives the maintenance unit 20 to move between the withdrawal and purge positions synchronously with the movement of the belt conveyor mechanism 13 between the conveyance and non-conveyance positions. This is a suitable construction for the line type printer 1 of the above-described embodiment.

The maintenance unit 20 is moved along the longitudinal direction of each ink-jet head 2, i.e., transversely in FIG. 2. This can avoid problems in which inks of different colors are mixed with each other and ink is apt to be collected on a side face in the width of each ink-jet head 2, which problems may arise in case that the maintenance unit 20 is moved along the width of each ink-jet head 2, i.e., transversely in FIG. 1.

The plural thin plates 44 included in the ink receiving member 30 are arranged in parallel with each other perpendicularly to the movement path of the maintenance unit 20. In this relatively simple structure, ink adhering to the nozzle faces 2*b* can be received in the space between the thin plates 44 and thereby the ink can be efficiently removed.

The wiping roller 41 is made of a porous material and absorbs ink adhering to the nozzle faces 2*b*, in the first wiping step. Therefore, a large amount of ink does not stay on the surface of the roller 41. Thus, efficient ink removal can be performed.

The wiping roller 41 is rotatable around the shaft 40 parallel to the nozzle faces 2*b*. In the first wiping step, the wiping roller 41 is rotated with being in contact with the nozzle faces 2*b*, attendant upon the movement of the maintenance unit 20. Further, this wiping roller 41 can perform an efficient ink removal because the rotation brings relatively less dirty part of the surface of the wiping roller 41 into contact with the nozzle faces of the ink-jet heads 2.

The wiping roller 41 is disposed on the side of the ink receiving member 30 opposite to the purge caps 22. This makes it easy to move the maintenance unit 20 so that the purge step with the purge caps 22, the ink receiving step with the ink receiving member 30, and the first wiping step with the wiping roller 41 are performed in this order. Further, the blade 43 is disposed on the side of the wiping roller 41 opposite to the ink receiving member 30. This makes it easy to move the maintenance unit 20 so that the purge step, the ink receiving step, the first wiping step, and the second wiping step with the blade 43 are performed in this order.

The maintenance unit 20 further includes the blade 43 and the second wiping step with the blade 43 is performed after the first wiping step with the wiping roller 41. Therefore, ink can be removed more efficiently and any part of the ink can be prevented from remaining after wiping, and at the same time, the ink meniscus can be maintained in a normal state. In particular, if wiping with the blade 43 is performed in a state wherein a large amount of ink has adhered to the nozzle faces 2*b*, ink may fly within the apparatus or ink may be collected on end portions of the ink-jet heads. In this embodiment, however, those problems can be relieved because the wiping roller 41 already removed some part of ink when wiping with the blade 43 is performed.

The blade 43 is for scraping off ink adhering to the nozzle faces 43. Therefore, ink remaining even after wiping with the wiping roller 41 can be effectively scraped off to be removed from the nozzle faces 2*b*.

The blade 43 is made of a flexible material. Therefore, it can come into close contact with the nozzle faces 2*b* without any gap with being bent as illustrated in FIG. 8. Thus, an ink wiping operation can be efficiently performed and this prevents any part of ink from remaining, The blade 43 may not be made of such a flexible material if it can wipe ink up. Further, the means used in the second 6 wiping step is not limited to a member capable of scraping ink off, such as the blade 43. The second wiping step Can be performed using any adequate member capable of wiping ink up.

Further, within the maintenance unit 20, the blade 43, the wiping roller 41, the ink receiving member 30, and the purge caps 22 may not always be arranged in this order. That is, irrespective of the arrangement of the components, the maintenance unit 20 may be moved so that the purge step, the ink receiving step, the first wiping step, and the second wiping step are performed in this order.

Further, the second wiping step with the blade 43 or the like may not be performed, In this case, after the ink receiving step with the ink receiving member 30, only the first wiping step with the wiping roller 41 is performed.

Further, the member used in the first wiping step is not limited to the wiping roller 41 that has the shaft 40 and can be rotated with being in contact with the nozzle faces 2*b*.

Various other members are usable if it can be in contact with the nozzle faces 2*b* to wipe up ink adhering to the nozzle faces 2*b*. In addition, the member used in this step may not be made of such a porous material capable of absorbing ink.

Further, the arrangement of the plural thin plates 44 within the ink receiving member 30 is not limited to that perpendicular to the movement path of the maintenance unit 20. In addition, the thin plates 44 may confront each other in a direction not along the movement path of the maintenance unit 20. Further, the ink receiving member 30 is not limited to the above construction including the plural thin plates 44. For example, the ink receiving member 30 may include a large number of standing needles like a frog. Otherwise, the ink receiving member 30 may include a large number of needlelike members each having its tip end branching into a Y shape to improve the ink receiving performance. Further, each gap between protrusions within the ink receiving member 30 can be connected to an adequate absorption means to increase the ink receiving capacity of the ink receiving member 30. As this absorption means, the above-described purge pump can be used. That is, the purge pump may be connected also to the ink receiving member 30, This makes the construction simple.

Further, the maintenance unit 20 may be moved not along the longitudinal direction of each ink-jet head 2 but along the width of each ink-jet head 2, i.e., transversely in FIG. 1.

Further, the belt conveyor mechanism may not be movable between the conveyance and non-conveyance positions. It may be fixed. Further, not the maintenance unit 20 but the ink-jet heads 2 may be moved for maintenance. This may be suitable for a serial-type printer in which printing is performed with moving a print paper and reciprocating a head main body perpendicularly to the movement of the print paper, different from a line type printer as that of the above-described embodiment in which printing is performed with moving a print paper relatively to the fixed ink-jet heads 2. That is, the present invention is not limited to a line type printer and it is applicable also to a serial-type printer.

Further, the present invention is not limited to an ink-jet printer and it is applicable also to an ink-jet type facsimile or copying machine.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet recording apparatus comprising:

a medium conveyance mechanism that conveys a record medium;

an ink-jet head that has a nozzle face where a plurality of nozzles are arranged, for ejecting ink through the nozzles onto the record medium conveyed by the medium conveyance mechanism; and a maintenance unit, the maintenance unit comprising:

an ink receiving member in which a plurality of protrusions are arranged, the protrusions being able to be brought into contact with ink adhering to the nozzle face, for receiving the ink in a space between the protrusions;

a first wiping member that is able to be brought into contact with the nozzle face to wipe up ink adhering to the nozzle face; and a driving mechanism that moves the maintenance unit so that the ink receiving member receives ink adhering to the nozzle face and then the first wiping member wipes up ink adhering to the nozzle face.

2. The ink-jet recording apparatus according to claim 1, wherein the maintenance unit further comprises a purge cap that sucks ink out of each of the nozzles; and the driving mechanism moves the maintenance unit so that the purge cap sucks ink out of the nozzles, and then the ink receiving member receives ink adhering to the nozzle face.

3. The ink-jet recording apparatus according to claim 2, wherein the medium conveyance mechanism can shift between a conveyance position and a non-conveyance position spaced apart from the nozzle face, and the driving mechanism moves the maintenance unit so that the purge cap confronts the nozzle face when the medium conveyance mechanism is in the non-conveyance position.

4. The ink-jet recording apparatus according to claim 1, wherein the driving mechanism moves the maintenance unit along a longitudinal direction of the ink-jet head.

5. The ink-jet recording apparatus according to claim 1, wherein the protrusions of the ink receiving member are thin plates arranged parallel to each other, each thin plate being along a direction perpendicular to a movement path of the maintenance unit.

6. The ink-jet recording apparatus according to claim 1, wherein the first wiping member is made of a porous material capable of receiving ink.

7. The ink-jet recording apparatus according to claim 1, wherein the first wiping member has a rotational axis parallel to the nozzle face and the first wiping member is rotated with being in contact with the nozzle face attendant upon movement of the maintenance unit.

8. The ink-jet recording apparatus according to claim 1, wherein the maintenance unit further comprises a purge cap that sucks ink out of each of the nozzles; and the first wiping member is arranged on a side of the ink receiving member opposite to the purge cap.

9. The ink-jet recording apparatus according to claim 1, wherein the maintenance unit further comprises a second wiping member that is able to be brought into contact with the nozzle face to wipe up ink adhering to the nozzle face, and the driving mechanism moves the maintenance unit so that the ink receiving member receives ink adhering to the nozzle face, the first wiping member wipes up ink adhering to the nozzle face, and then the second wiping member wipes up ink adhering to the nozzle face.

10. The ink-jet recording apparatus according to claim 9, wherein the second wiping member is a blade that scrapes ink off.

11. The ink-jet recording apparatus according to claim 10, wherein the blade is made of a flexible material.

12. The ink-jet recording apparatus according to claim 9, wherein the maintenance unit further comprises a purge cap that sucks ink out of each of the nozzles; and the first wiping member is arranged on a side of the ink receiving member opposite to the purge cap, and the second wiping member is arranged on a side of the first wiping member opposite to the ink receiving member.

13. A maintenance method of an ink-jet head, the method comprising:

an ink receiving step for bringing ink adhering to a nozzle face on the ink-jet head where a plurality of nozzles are arranged into contact with protrusions arranged on an ink receiving member so as to receive the ink in a space between the protrusions; and a first wiping step for bringing a first wiping member into contact with the nozzle face so as to wipe up ink adhering to the nozzle face with the first wiping member, after the ink receiving step.

14. The maintenance method according to claim 13, wherein the first wiping member absorbs therein ink adhering to the nozzle face.

15. The maintenance method according to claim 13, further comprising a second wiping step for bringing a second wiping member into contact with the nozzle face so as to wipe up ink adhering to the nozzle face with the second wiping member, the second wiping step being performed after the first wiping step.

16. The maintenance method according to claim 15, wherein the second wiping member scrapes off ink adhering to the nozzle face.

17. The maintenance method according to claim 13, further comprising:

a cap arrangement step for arranging a purge cap that sucks ink out of each nozzle so that the purge cap confronts the nozzle face; and a purge step for sucking ink out of the nozzles, the cap arrangement step and the purge step being performed before the ink receiving step.

* * * * *